US005683083A

United States Patent [19]

Karabekian et al.

[11] Patent Number: 5,683,083

[45] Date of Patent: Nov. 4, 1997

[54] TOP GAME AND METHOD OF PLAYING SAME

[76] Inventors: Hovanes Grikor Karabekian, 1103½ Alma St., Glendale, Calif. 91202-2058; Karine Ghevond Tonoyan, 212 E. Dryden, #C, Glendale, Calif. 91207

[21] Appl. No.: 489,296

[22] Filed: Jun. 8, 1995

[51] Int. Cl.[6] ..... A63F 9/16

[52] U.S. Cl. ..... 273/128 R; 446/257; 446/261

[58] Field of Search ..... 273/128 R, 108, 273/109, 110, 317, 428, 440, 456, 447; 446/256, 257, 258, 259, 260, 261, 262, 263, 264

[56] References Cited

U.S. PATENT DOCUMENTS

| | | | |
|---|---|---|---|
| 1,889,680 | 11/1932 | Marmito | 446/261 |
| 2,671,663 | 3/1954 | Gurt et al. | 446/256 |
| 3,044,212 | 7/1962 | Lancaster | 446/261 |
| 3,815,911 | 6/1974 | Cooper | 446/257 |
| 4,982,961 | 1/1991 | Ichimura | 446/259 |
| 5,026,057 | 6/1991 | Watford | 446/256 |

*Primary Examiner*—William M. Pierce
*Attorney, Agent, or Firm*—James E. Brunton

[57] ABSTRACT

A top game apparatus and the method of playing the same in which one or more players move a target top along a playing field toward a goal by striking the target top with a spinning top thrown from the player's hand toward the target top. The game apparatus includes a top-like game piece, a novel pull string, and a unique packaging and transport container for containing the game pieces.

4 Claims, 2 Drawing Sheets

TOP GAME AND METHOD OF PLAYING SAME

BACKGROUND OF THE INVENTION

1. Field of the Invention

The present invention relates generally to outdoor games. More particularly, the invention concerns a game of skill played on an outside playing field and involves the use of a game playing apparatus including spinning tops which serve as game pieces.

2. Discussion of the Invention

A number of outside games such as lawn bowling, croquet, tennis, badminton, and putting are played and enjoyed all over the world. Such games, which require varying degrees of skill, provide exercise as well as wholesome enjoyment and can be played by young and old alike.

While spinning tops in and of themselves are old and have long been enjoyed, especially by children, they have not been incorporated into a field game of skill of the character that can be played by two or more individuals or teams of individuals wherein the top functions as a game piece. Where, such as is here the case, the game requires concentration and a high degree of hand-eye coordination it is interesting, invigorating and quite challenging even to those who are especially athletically inclined.

SUMMARY OF THE INVENTION

By way of summary, the game of the present invention is played on a playfield having a relatively hard surface and uses specially designed spinning tops as game pieces. Proximate one end of the playing field is the goal which is preferably provided in the form of a recessed, basket-like cup somewhat similar to the cup used in the game of golf. The object of the game is to move the top, or play piece, of one of the players, who is temporarily inactive, (the "target top") along the playing field and into the cup using only the spinning tops (the "striking tops") of the other active players who play sequentially. If, during the play, the target top of the inactive player, after being struck, comes to rest on its planar surface, the inactive player takes the place of the "shooter" and the latter's top is placed in the position of the inactive player's top and becomes the target top for continued movement thereof toward the goal.

During play, the various players take turns spinning the striking tops and striking the target top. As the target top is struck, it is moved closer and closer to the goal basket. The player who first causes the target top to drop in the basket wins and takes the target top as a trophy or is credited with a score. If, however, the target top lands on its planar surface within the goal basket, the player to whom the target top belongs would be declared the winner. Other rules of play, which will be discussed more fully hereinafter, make the game both challenging and exciting.

It is an object of the present invention to provide a novel top game and the method of playing the same in which one or more players move a target top along a playing field toward a goal by striking the target top with a spinning top thrown from the player's hand toward the target top.

Another object of the invention is to provide a top game of the aforementioned character which can be played by one or more players of various ages and one which can be played on outdoor playing fields of various sizes.

Another object of the invention is to provide a game of the character described in which the game piece comprises a string-powered, spinning toy that provides exercise, imagination, and all around fun for players of various ages.

Another object of the invention is to provide a game as described in the preceding paragraphs which requires no batteries or external sources of power and one which develops superior hand-eye coordination and markedly improves the dexterity of the player.

Still another object of the invention is to provide a game of the class described in which the playing pieces can be transported in a novel transport container which includes means for maintaining the tip of the playing piece sharp by merely rotating the cover of the transport package.

Another object of the invention is to provide a transport container of the character described in the preceding paragraph which is capable of carrying a plurality of tops in a stacked relationship and includes a unique, generally spherically shaped, central support which engages the tips of the centrally disposed playing pieces or tops to maintain the stacked tops in alignment.

Another object of the invention is to provide a uniquely formed, top-like playing piece to which rotation can be imparted by a novel, elongated cord, one end of which is affixed to the player's finger and the opposite end of which is disposed in intimate frictional contact with the surface of the top in a manner to impart forces to the top tending to rapidly rotate it about its tip as the cord is unwound therefrom.

More particularly, it is an object of the invention to provide a game piece of the character just described in which one end of the spinning cord includes a plurality of individual strands which separately engage the top as the cord is wound about the conical body portion of the top.

Yet another object of the invention is to provide a game apparatus as described in the preceding paragraphs which is highly durable, has a long useful life and can be inexpensively manufactured.

DESCRIPTION OF THE INVENTION

Figure 2:
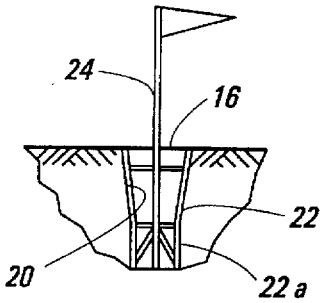
FIG. 2 is an enlarged, fragmentary view of the goal or cup portion of the playing surface.
Figure 1:
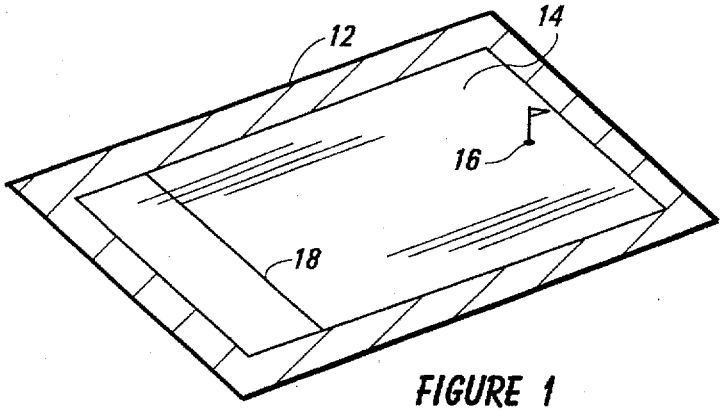
FIG. 1 is a generally perspective view of one form of the playing surface of the game of the invention.

Referring to the drawings and particularly to FIGS. 1 and 2, one form of the playing field of the present invention is there illustrated and generally designated by the numeral 12. The playing field, which can be of any size desired depending upon the number of players playing the game, includes a generally planar playing surface 14 within which a goal point or goal basket 16 is provided (FIG. 2). Goal basket 16 is located proximate one end of the playing surface 14 with a starting line 18 extending transversely of the playing field proximate the opposite end of the playing field. As best seen in FIG. 2, goal 16 comprises a depression 20 provided in the playing surface within which a goal basket 22 is closely received. Goal basket 22 is provided with a base portion 22*a* which functions to support an upstanding signal flag 24 which functions to make the location of the goal point readily visible to the players.

Figure 2B:
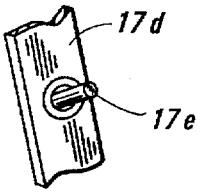
FIG. 2B is a greatly enlarged, generally perspective view of area 2A of FIG. 2B.
Figure 2A:
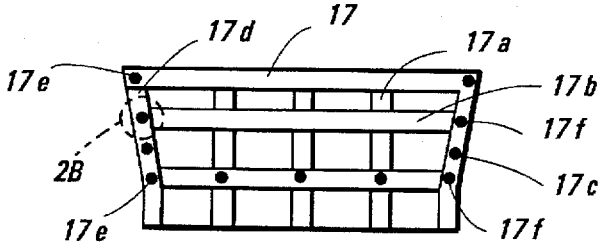
FIG. 2A is an enlarged side view of an alternate form of cup portion of the apparatus.

Turning to FIGS. 2A and 2B an alternate form of the goal basket side wall is there illustrated. This goal basket side wall comprises a flexible plastic sheet 17 formed with a plurality of intersecting vertical and horizontal bands 17*a* and 17*b*. Sheet 17 has an apertured end band 17*c* and a solid band 17*d* which is provided with outwardly extending locking protuberances 17*e* of the character shown in FIG. 2B which are lockably receivable within apertures 17*f* formed on side band 17*c*. With this construction, sheet 17 can be bent into a cup-defining, generally cone shape with protuberances 17*e* being lockably received within apertures 17*f*. A bottom plate can be provided to hold the flag or, alternatively, the flag can be supported in a base such as shown in FIG. 2 and designated as 22*a*.

The playing field is preferably located outdoors and can be of any desired size as, for example, 15 feet by 20 feet when two players are involved and 20 feet by 40 feet when more than two players are involved. The playing surface 14 should be relatively hard and can comprise an asphalt surface such as found on playgrounds, a concrete surface, a packed dirt surface or any other suitable playing surface which will support the rotating game pieces.

Figure 4:
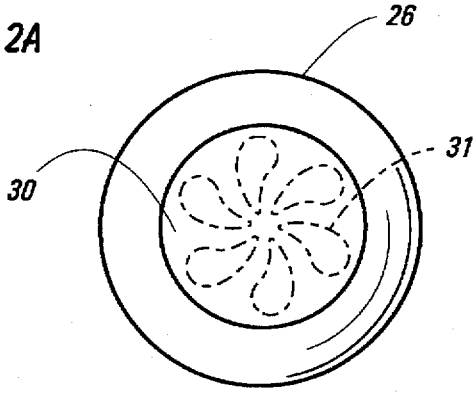
FIG. 4 is a top view of the top shown in FIG. 3.
Figure 3:
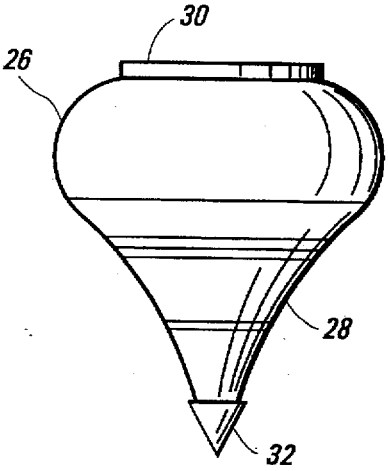
FIG. 3 is a side-elevational view of one form of the top which comprises a playing piece of the game of the invention.

Turning to FIGS. 3 and 4, one form of the game piece of the invention is there illustrated. This form of game piece comprises a top-like structure 26 having a conical body 28, a generally planar, top surface 30, and a surface-engaging tip 32 which is also preferably generally conical in shape. As indicated in FIG. 4, planar top surface 30 can be provided with various indicia 31 that can comprise fanciful designs, words, numbers or combinations thereof.

Figure 5:
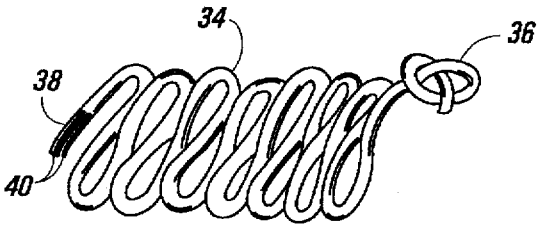
FIG. 5 is a generally perspective view of the cord used to impart a spinning motion to the top.

The game piece, or top 30, is designed so as to have a rotational moment of inertia for retaining dynamically imparted momentum to the top during the spin time of the top when the top is spun by the players using the rotation-imparting means, one form of which is shown in FIG. 5. This rotation-imparting means is here provided as an elongated cord 34 having a first end 36 which can be securely wrapped about the players finger and a second end 38 which comprises a plurality of individual surface gripping fibers or strands 40 for securely gripping the body of the top. The manner of use of cord 34 to impart rotation to top 30 will presently be described.

Figure 6:
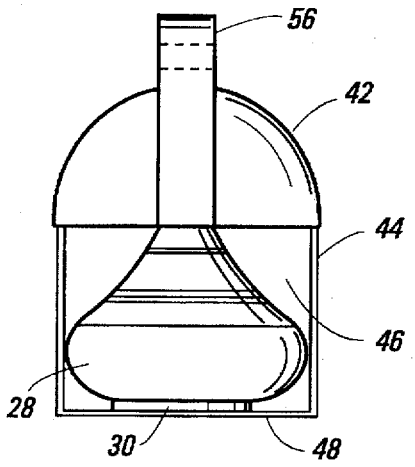
FIG. 6 is a side-elevational view of one from of the container for containing a top such as shown in FIG. 3.
Figure 7:
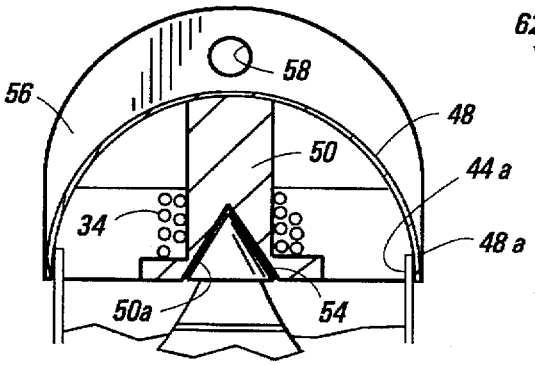
FIG. 7 is an enlarged, fragmentary from view partly in cross section of the carrying case illustrating in detail the upper portion thereof which closely receives the surface engaging or tip portion of the top.

Forming an important aspect of the game playing apparatus of the present invention is packaging and transport means for packaging the top and the rotation imparting means. Referring to FIG. 6, one form of the packaging and transport means of the present invention is there illustrated and generally designated by the numeral 42. Turning also to FIG. 7, it is to be noted that packaging means 42 comprises a hollow housing 44 having an interior, top-receiving chamber 46 and a generally planar bottom portion 48 for supporting a selected one of the tops 28 on its generally planar, surface 30. Removably interconnected with hollow housing 44 is a cover means for closing the open top 44*a* of housing 44 (FIG. 7). As best seen in FIG. 7, the cover means here comprises a cover member 48, which is generally hemispherical in shape, and includes a circumferentially extending flange portion 48*a* which is closely receivable over the open top 44*a* of hollow housing 44.

Figure 9:
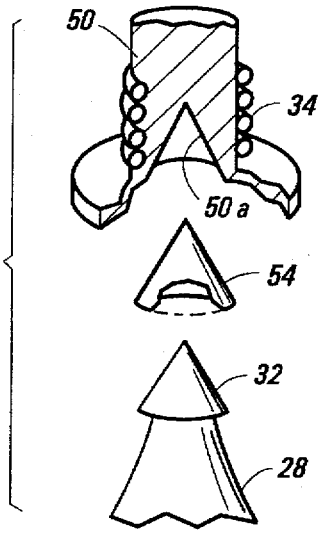
FIG. 9 is an enlarged, generally perspective, exploded view of the top portion of the carrying case for receiving and sharping the point of the game piece.

Supported within cover member 48 is a novel tip sharpening means for sharpening the tip 32 of the playing piece or top 28. This tip sharpening means, which forms an important aspect of the present invention, is carried within a tip receiving cavity 50*a* formed in a upwardly extending column 50. Column 50 comprises a part of the support means of the invention for supporting cord 34 in the coiled configuration shown in FIG. 7 which is formed by wrapping the cord around and about column 50 in the manner illustrated in FIG. 7. Turning next to FIG. 9, it can be seen that the novel tip sharpening means of the present invention is provided in the form of a generally conically shaped, abrasive-carrying member 54. Member 54 can be constructed of a wide variety of materials, but preferably comprises a readily commercially available emery cloth material that is suitably formed into the conical configuration shown in FIG. 9. Abrasive member 54 is preferable bonded within cavity 50*a* by any suitable bonding agent such as an epoxy resin so that the interior, abrasive-covered surface thereof engages tip 32 when the cover is emplaced over the hollow housing in the manner illustrated in FIG. 7. With the cover thus positioned over tip 32, rotation of the cover using the finger-engaging means of the invention will cause the abrasive carried on member 54 to abrade the outer surface of tip 32 in a manner to provide a sharp apex or point on the playing surface-engaging tip. As best seen in FIGS. 6 and 7, the finger-engaging means of the present invention comprises an upstanding, transversely extending finger-engaging member 56 which is generally crescent shaped and is preferably integrally formed with cover 48. Finger-engaging member 56 is provided with a centrally disposed aperture 58 within which a carrying cord or chain can be received.

Figure 8:
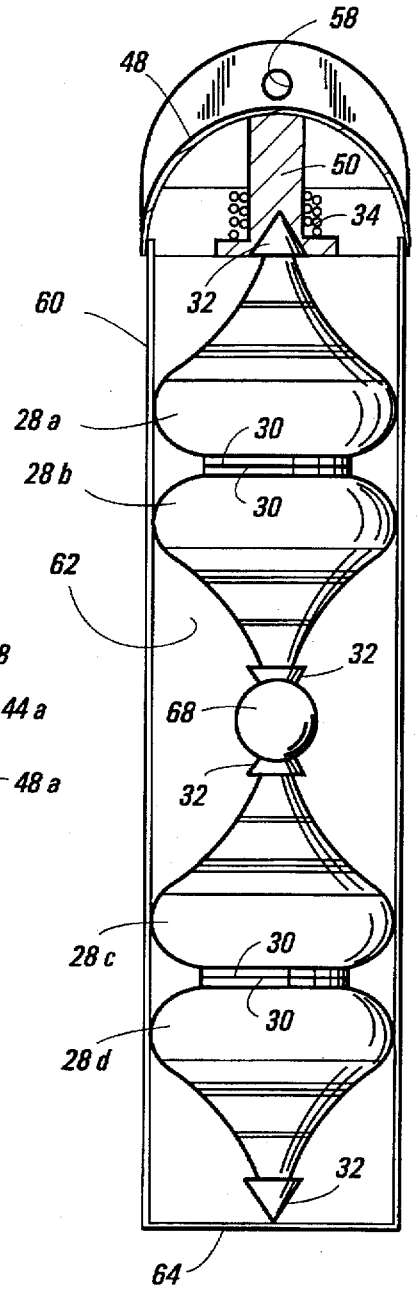
FIG. 8 is a side-elevational view of an alternate form of carrying case for carrying a plurality of game pieces of the invention.
Figure 8A:
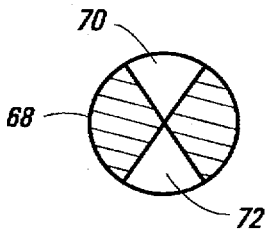
FIG. 8A is a cross-sectional view of the controllably disposed top support member shown in FIG. 8 for supporting the intermediate pair of tops.

Turning next to FIG. 8, another form of packaging means or transport container of the present invention is there illustrated. This form of packaging means is similar in many respects to that illustrated in FIGS. 6 and 7 and like numerals are used in FIG. 8 to describe like components. The primary difference between the packaging means shown in FIGS. 6 and 7 and that shown in FIG. 8 resides in the fact that the packaging means of FIG. 8 comprises a housing 60 which has an elongated interior chamber 62 that will receive a plurality of playing pieces or tops 28 in a stacked configuration. These tops, designated in FIG. 8 by the numerals 28*a*, 28*b*, 28*c*, and 28*d* are of the character previously described with each having a planar portion 30 and a tip portion 32. The tops are stacked and then placed within chamber 62 in the following manner:

First the planar surface of top 28*b* is placed upon a flat surface as, for example, a table top, a chair, a pavement border, a bench or the like. Next, the tip receiving means of the invention, which is here provided in the form of a support member 68 is placed over the tip of top 28*b*. As best seen by referring to FIG. 8A, support member 68 is provided with opposing, generally conically shaped, cavities 70 and 72. With the tip portion of top 28*b* closely received within cavity 70 of support member 68, tops 28*c* and 28*d* are then stacked one on top of the other with their planar surfaces in engagement and with the tip portion of top 28c inserted into cavity 72 of support member 68. This done, the three tops 28b, 28c, and 28d, along with support member 68 are securely gripped with one hand. Using the other hand, the open end of inverted housing 60 is carefully emplaced over the assemblage. Finally, the planar surface of top 28a is slidably mated with the planar surface of top 28b and housing 60 is carefully moved downwardly over top 28b so as to encapsulate the entire assembly comprising tops 28a, 28b, 28c, and 28d along with support member 68 which is disposed intermediate tops 28b and 28c. Housing 60 is then inverted so that the open end thereof is exposed and cover 48 is positioned over the open end 60 so that cavity 50a of the cover closely receives the upwardly extending tip of top 28a.

The method of emplacement of the tops within housing 60, as described in the preceding paragraph, provides a supplementary exercise for a child playing the game and causes the child to focus its attention and further develop its manual dexterity. Accordingly, the stacking of the tops and emplacing the housing 60 over the tops comprises a game within a game further stimulating the interest and challenge of the players. When the tops are removed from housing 60, support member 68 should be stored within housing 60 at all times to prevent it becoming misplaced or lost. Additionally, when four tops are stored within container 60, it is preferable to provide four separate cords, one for each top, so that four individuals can begin the game at the same time without the need of transferring a single cord from one to the other. This independence of action at the start of the game, once again, stimulates maximum concentration on the part of the players. As best seen in FIG. 8, when the tops are positioned within chamber 62 of the packaging means, tip 32 of top member 28c is closely received within conically shaped cavity 72, while tip 32 of top member 28b is closely received within conically shaped chamber 70. With this construction, the four tops disposed within the packaging means are maintained in precise axial alignment with the axial center line of the hollow housing 60. The cover means of this form of the invention, as well as the tip sharpening and support means, are identical to that previously described in connection with FIG. 7 and comprise a central column 50 about which cord 34 can be wrapped in the manner shown in FIG. 8.

In accordance with one form of the method of the present invention, each player is provided with a playing piece or top of the general character illustrated in FIG. 3. Indicia 31, which is provided on the planar portion 30 of the top can represent the initials of the player or can comprise pictures, heros of fairy tales, sportsmen, movie actors, singers, alphabet letters, flowers, fruits, butterflies, or any other suitable indicia that might be coveted by a particular player. After the playing pieces have been selected by the players, the order of play is determined by casting all of the playing pieces into the air and allowing them to fall to the playing surface. If any one of the playing surface lands on its planar or flat surface 30, the player that selected that particular game piece will be permitted to play first. The step of casting the remaining tops into the air is repeated until the top of each of the players lands on its planar surface thereby establishing the order of play for the ensuing game.

At the commencement of play, the player whose top has not yet landed on its planar surface 30 during the step of ordinary play, places his or her top on the starting line 18 and this top becomes the target top. The first ordered player then spins his or her top on the playing surface by wrapping cord 34 securely around the top and then imparting a throwing motion to the top causing the cord to unwind therefrom and impart a rapid rotational motion to the top. It is important to note that during the cord winding operation, the individual filaments or strands 38 on the cord will spread apart and securely grip the conical surface of the top 28 so that, as the cord is unwound from the top, the cord will impart a substantial spinning momentum to the top permitting it to spin rapidly on the supporting surface.

With the top rapidly spinning on the supporting surface, the first player using either the right or left hand scoops up the spinning top in a manner to cause the top to continue to spin on the palm of the player's hand. In this regard, for children and female players, it may be desirable that a glove or some type of protective pad on the palm of the hand be used during play. With the top rapidly spinning within the palm of the player, the player preferably using an underhand throwing motion throws the spinning top toward the target top positioned on line 18. The spinning top is thrown at the target top in such a manner as to cause the target top to move in a direction toward the goal point 16. This done, the next player to play, that is one of the intermediate players selected between the first and last players, imparts a spinning motion to that player's top in the manner previously described. As the player's top is spinning on the playing surface, the intermediate player, using either the right or left hand, scoops up the spinning top so that it will continue to spin within the player's palm. With the top thus spinning, the intermediate player, using a throwing motion, strikes the target top which now rests on the playing surface intermediate line 18 and goal 16 thereby causing the target top to further advance toward the goal point 16. This type of sequential play is continued by each of the intermediate players until the target top finally falls into the goal or basket 22. The intermediate player, who was successful in knocking the target top into the goal, collects the target top as a prize or is credited with a score and another game is commenced by once again casting the tops into the air to select order of play.

An exception to the method described in the preceding paragraphs occurs if the target top falls into the goal basket 22 and comes to rest on its planar surface 30. In this case the intermediate player who last struck the target top is deemed to be the loser and must forfeit his or her top to the intermediate player that struck the top into the goal. Another variation to the method of play comes about should an intermediate player on his or her turn either fails on the first try to satisfactorily impart a spinning motion to the top or fails to scoop the top up and retain a spinning configuration during the casting step. Also a player is never allowed to touch the target top during play. If any of these events occur, the offending intermediate player is immediately disqualified from further play. Additionally, if after a blow is struck to the target top, both tops land on their planar surface 30 the game is continued because in that position the striker has excess and his top "saves" his master.

By way of summary, the components of the apparatus of the game can be constructed from a wide variety of material. For example, the playing pieces or tops 28 can be constructed of wood, metal, plastic, or any suitable composite material. Similarly, the packaging or transport containers can be constructed from wood, opaque or transparent plastic, or any suitable rigid material. Preferably the tip portions 32 of the playing pieces are constructed from a metal, such as brass or stainless steel, so that they can be maintained sharp by the tip sharpening means of the invention. Support member 68 can similarly be constructed of wood, plastic, or any other suitable material, basket 22 can be constructed from yieldable plastic and cord 34 can be constructed from a soft cotton or like material which is relatively soft and substantially non-stretchable. As previously mentioned, materials should be such that end portion 38 can take on the brush-like construction illustrated in FIG. 5 thereby enabling it to be looped firmly around the playing piece so as to transmit maximum rotational velocity to the playing piece during play.

It is to be understood that the game can be organized in such a way that two persons can play as individuals or play can be by teams. The teams can include three to four players with the players also playing independently if desired. In team play, the game will continue until two players remain qualified. The game then continues between the two qualified players with the last player to be disqualified being named the victor.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A method of playing a game on a supporting surface having a goal and a spaced apart therefrom starting line, said game being playable by a plurality of players each having a game piece in the form of a top having a planer surface and a surface engaging apex and means for spinning the top, said method comprising the steps of:

(a) determining an order of play of said plurality of players to identify a first player, a plurality of intermediate player, and a last player;

(b) placing the top of said last player on the starting line;

(c) spinning the top of said first player on the supporting surface;

(d) using the hand of said first player, scooping up said spinning top in a manner to cause said spinning top to continue spin on the palm of said first player;

(e) using a throwing motion by said first player, throwing said spinning top toward said top of said last player in a manner to cause said top of said last player to move in a direction toward a goal point;

(f) spinning the top of one of said intermediate players on the supporting surface;

(g) using the hand of said one of said intermediate players, scooping up said spinning top of said one of said intermediate players in a manner to cause said spinning top to continue to spin on the palm of said one of said intermediate players;

(h) using a throwing motion by said one of said intermediate players, throwing said spinning top toward said top of said last player in a manner to cause it to move further in a direction toward the goal point; and (i) continuing the steps of spinning, scooping and using in a throwing motion by said first and intermediate players until said top of said top of said last player, reaches said goal point.

2. A method as defined in claim 1 in which order of play is determined by simultaneously casting said game pieces into the air and noting an orientation of said game pieces when they land.

3. A method as defined in claim 1 including the further step of replacing said top of said last player with said top of a first player or an intermediate player should said top of said last player, after being struck, comes to rest on its planar surface.

4. A method as defined in claim 1 including the further step of disqualifying from play a first player or any intermediate player who, during play, fails to spin the top on the supporting surface.

* * * * *